US007556479B2

(12) United States Patent
Foor

(10) Patent No.: US 7,556,479 B2
(45) Date of Patent: Jul. 7, 2009

(54) POWER STEERING PUMP RELIEF SYSTEM FILTER

(75) Inventor: William Joseph Foor, Clayton, MI (US)

(73) Assignee: Ford Motor Company, Dearborn, MI (US)

( * ) Notice: Subject to any disclaimer, the term of this patent is extended or adjusted under 35 U.S.C. 154(b) by 226 days.

(21) Appl. No.: 11/504,165

(22) Filed: Aug. 15, 2006

(65) Prior Publication Data

US 2008/0044297 A1 Feb. 21, 2008

(51) Int. Cl.
*F04B 49/035* (2006.01)
*G05D 16/10* (2006.01)

(52) U.S. Cl. ..... 417/307; 137/115.04

(58) Field of Classification Search ..... 417/307, 417/313; 137/115.03, 115.04, 115.09, 115.14
See application file for complete search history.

(56) References Cited

U.S. PATENT DOCUMENTS 4,251,193 A * 2/1981 Minnis et al. ..... 417/300
4,410,302 A * 10/1983 Chiba et al. ..... 417/299
4,420,290 A * 12/1983 Drutchas ..... 417/283
5,092,742 A * 3/1992 Allen et al. ..... 417/313

* cited by examiner

*Primary Examiner*—Devon C Kramer
*Assistant Examiner*—Philip Stimpert

(57) ABSTRACT

Accordingly, the present invention provides a power steering pump having a filter that removes contaminants from fluid flowing through the relief system of the power steering pump. The power steering pump includes a housing having a longitudinal bore communicating with a fluid outlet. A fluid discharge port communicates with the bore and a fluid bypass port also communicates with the bore. A flow control member is situated in the bore and forms a outlet passage communicating with the fluid outlet. A flow control valve is slidably received in the bore. The flow control valve operates to open and allow communication between the fluid discharge port and the outlet passage in the flow control member. When the fluid flow from the fluid discharge port reaches a suitable pressure, the valve opens further to allow fluid flow from the fluid discharge port to the bypass port. A fluid pressure passage communicates pressure from the fluid outlet to a pressure sensing chamber forming part of the flow control valve assembly. A filter located downstream from the flow control member operates to filter fluid passing through the fluid pressure passage, and thereby, prevents contamination from entering the relief system of the power steering pump.

8 Claims, 2 Drawing Sheets

POWER STEERING PUMP RELIEF SYSTEM FILTER

CROSS-REFERENCE TO RELATED APPLICATIONS

Not Applicable

BACKGROUND OF THE INVENTION

1. Field of the Invention

The present invention relates generally to power steering pumps and more specifically to an assembly that filters fluid directed to a relief system.

2. Description of Related Art

A power steering system used with an automotive vehicle typically utilizes a pump that provides hydraulic fluid under pressure. The pump includes a rotor having retractable vanes rotating within a cam chamber. The pump draws hydraulic fluid into the cam chamber from a fluid suction passage and pumps out the hydraulic fluid under pressure to a fluid discharge port. A belt and pulley assembly connected to the vehicle engine drives the pump. Accordingly, as the speed of the engine increases the volume of fluid pumped by the rotor also increases. It is desirable to maintain the pump output at a constant level. Accordingly, the pump includes a recycling or bypass system located in the pump housing that diverts fluid from the outlet or fluid discharge port to the suction passage.

The pump may include a mechanical valve that opens and closes the fluid bypass port to regulate pump output. The mechanical valve is a flow control valve disposed in a bore located in the pump housing. The bore communicates with and connects the fluid discharge port and the fluid bypass port. Accordingly, the flow control valve moves within the bore to open and close the bypass port. A spring located in the bore biases the valve towards a closed position. A relief system fluid flow passage extends between and provides a feedback pressure from the pump output to a pressure chamber located at or adjacent one end of the flow control valve. This feedback pressure combines with the spring force to keep the bypass port closed.

The flow control valve may include a slideable piston that engages a flow control fitting. As known, the flow from the pump exerts pressure on the piston, when the pressure exceeds the force provided by the spring, the piston will move away from the flow control fitting and the fluid will flow through the fitting to the output. If the pressure continues to increase the piston is forced further back until it uncovers the bypass port enabling excess fluid to recirculate to the pump. If the flow demand increases, the pressure will decrease and the spring forces the piston back toward the fitting to a new flow regulating position. Accordingly, the piston moves toward and away from the flow control fitting in response to changes in the pressure demand.

Occasionally contamination, either through the manufacturing process, degradation of steering system components or through system maintenance, enters the system and can clog or become lodged in the relief valve or relief system fluid flow passage of the power steering pump. This leads to higher effort on the part of the vehicle operator as the power steering system is prohibited from building pressure and thus supplies a lower amount of assistance to the vehicle operator. One manner of preventing contamination is to install a filter on the end of the relief valve. This method does not prevent contamination from becoming lodged between the valve and the valve bore. In addition, excessive contamination may cover the filter and there may be no pressure relief for the power steering system.

Therefore, a need exists for a power steering pump having a system that filters fluid directed through the relief system of the power steering pump to the relief valve and reduces the opportunity for contamination to lodge in the relief valve in a manner that reduces steering system pressure.

SUMMARY OF THE INVENTION

Accordingly, the present invention provides a power steering pump having a filter that removes contaminants from fluid flowing through the relief system of the power steering pump. The power steering pump includes a housing having a longitudinal bore communicating with a fluid outlet. A fluid discharge port communicates with the bore and a fluid bypass port also communicates with the bore. A flow control member is situated in the bore and forms an outlet passage communicating with the fluid outlet. A flow control valve is slidably received in the bore. The flow control valve operates to open and allow communication between the fluid discharge port and the outlet passage in the flow control member. When the fluid flow from the fluid discharge port reaches a suitable pressure, the valve opens further to allow fluid flow from the fluid discharge port to the bypass port. A fluid pressure passage communicates pressure from the fluid outlet to a pressure sensing chamber forming part of the flow control valve assembly. A filter located downstream from the flow control member operates to filter fluid passing through the fluid pressure passage, and thereby, prevents contamination from entering the relief system of the power steering pump.

In accordance with one aspect of the invention, the filter is a screen member that filters only the fluid entering the relief system of the power steering pump and does not filter fluid directed to the steering gear through the fluid outlet. Accordingly, the screen is also self-cleaning as contamination on the screen is washed away by the fluid as the fluid has an uninterrupted flow path from the outlet passage to the fluid outlet of the power steering pump.

DETAILED DESCRIPTION OF THE PREFERRED EMBODIMENTS

Figure 1:
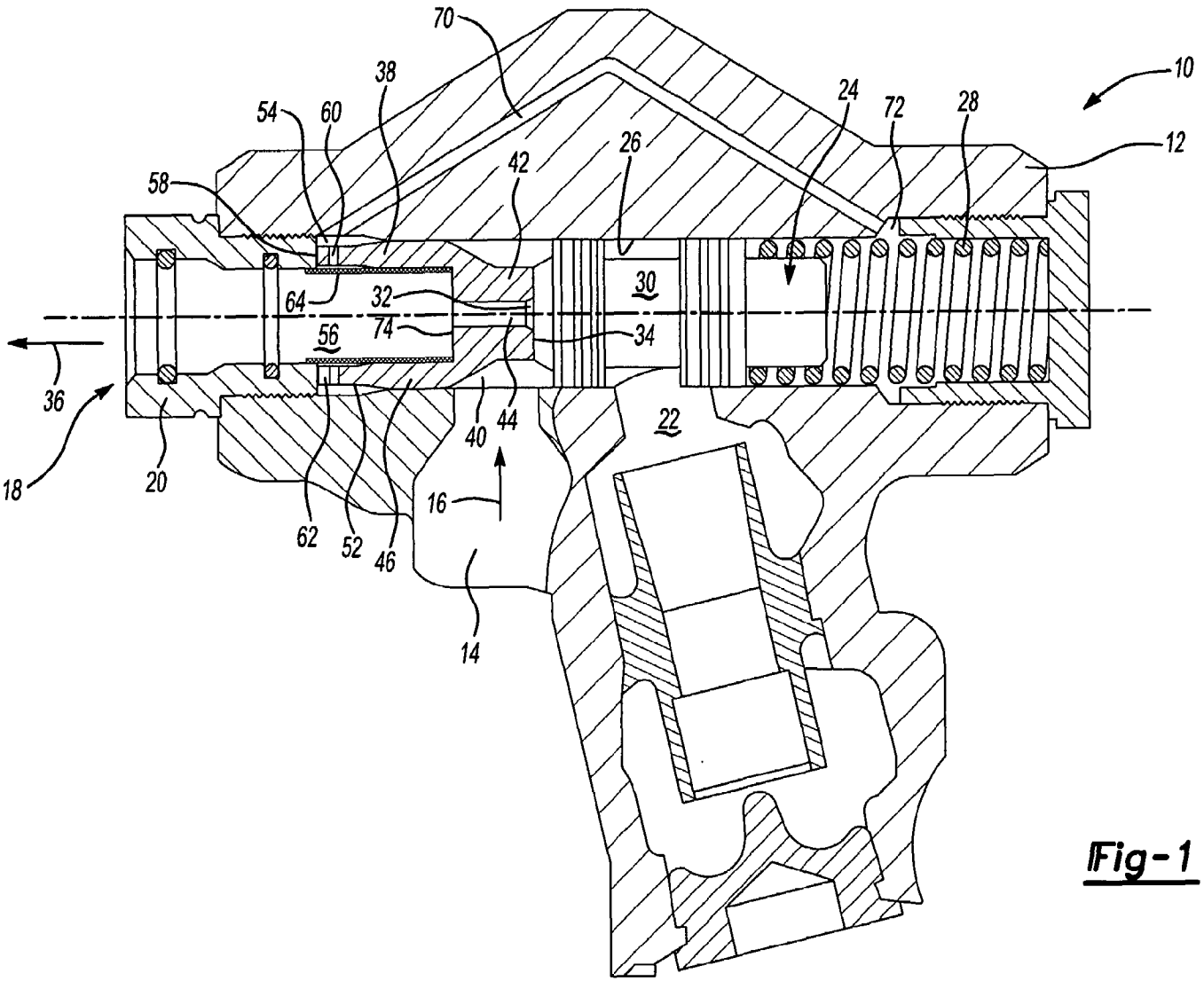
FIG. 1 is a cross section through the power steering relief valve and adjacent housing area.

FIG. 1 illustrates a partial view of a power steering pump, seen generally at 10, according to a preferred embodiment of the present invention. The power steering pump 10 supplies pressurized fluid for a power steering system used with an automobile. The pump comprises a housing 12 containing a pump element such as a rotor that rotates in a cam chamber. Such power steering pumps are well known and include a discharge port 14 carrying pressurized fluid from the cam chamber in the direction of the arrow 16. The housing 12 also includes a suction passage, not shown, for delivering fluid to the cam chamber. During operation, fluid is drawn into the cam chamber through the suction passage and is pumped under pressure to the discharge port 14 and ultimately through a fluid output 18 forward of an outlet fitting or adapter 20 that connects the power steering pump 10 to the rotary valve and steering gear of the power steering system. Fluid is returned to a return line (not shown) connected to the suction passage and is, in turn, drawn back into the cam chamber. Accordingly, the power steering pump operates in a known manner to supply the steering gear of the power steering system with pressurized fluid.

The volume of the pressurized fluid exiting the outlet fitting or adapter 20 is controlled by recycling a portion of the fluid through a bypass port 22 located in the housing 12. The bypass port 22 is connected to the suction passage whereby fluid traveling through the bypass port 22 flows into the suction passage and correspondingly flows into the cam chamber. A flow control valve assembly 24 operates to control the flow of fluid to the bypass port 22. As shown, the flow control valve 24 slides or moves in a reciprocal manner to open and close the bypass port 22 and thereby maintain the fluid flow output from the pump 10 to the steering system at a relatively constant level.

As illustrated, the housing 12 includes a bore 26, that communicates with the fluid discharge port 14 and the bypass port 22. The flow control valve assembly 24 is slidably disposed within the bore 26. The control valve assembly 24 includes a valve body 30. A spring 28 biases the valve body 30 in a closed position whereby a valve face 32 engages an orifice 34 which controls and regulates the fluid flow through the bore 26 and ultimately out of the housing 12 through the outlet fitting or adapter 20 in the direction shown by the arrow 36. The orifice 34 is part of a flow control member 38 seated in the bore 26. Accordingly, the valve assembly 24 operates in a known manner whereby fluid flow through the discharge port 14 enters the fluid flow chamber 40 to a point where pressure in the fluid flow chamber 40 acts on the valve body 30 and correspondingly the spring 28 to move the valve body 30 away from the orifice 34 whereby the fluid in the fluid flow chamber 40 flows through the orifice 34 and the outlet fitting or adapter 20 to the power steering system.

Figure 2:
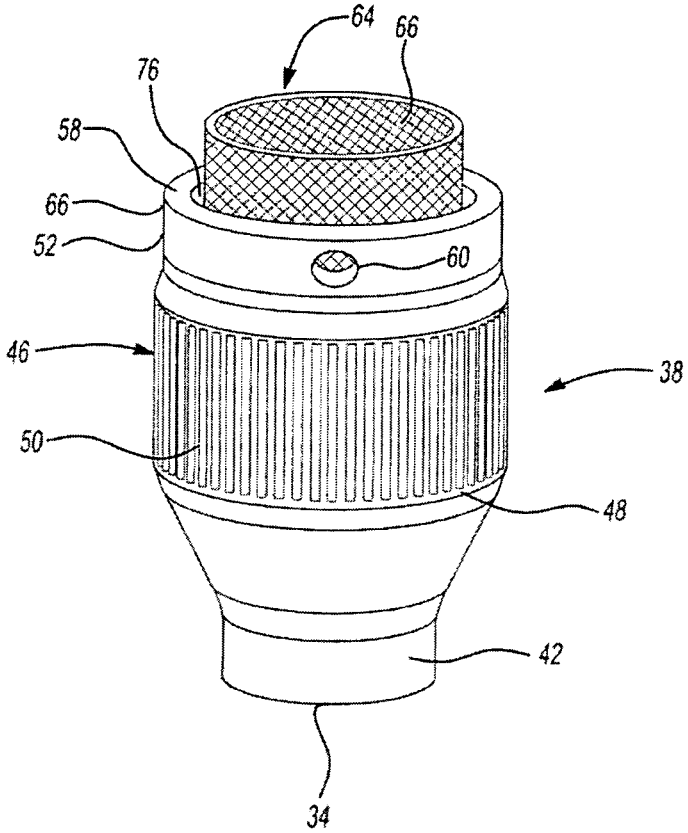
FIG. 2 is a perspective view of a flow control member including a filter.
Figure 3:
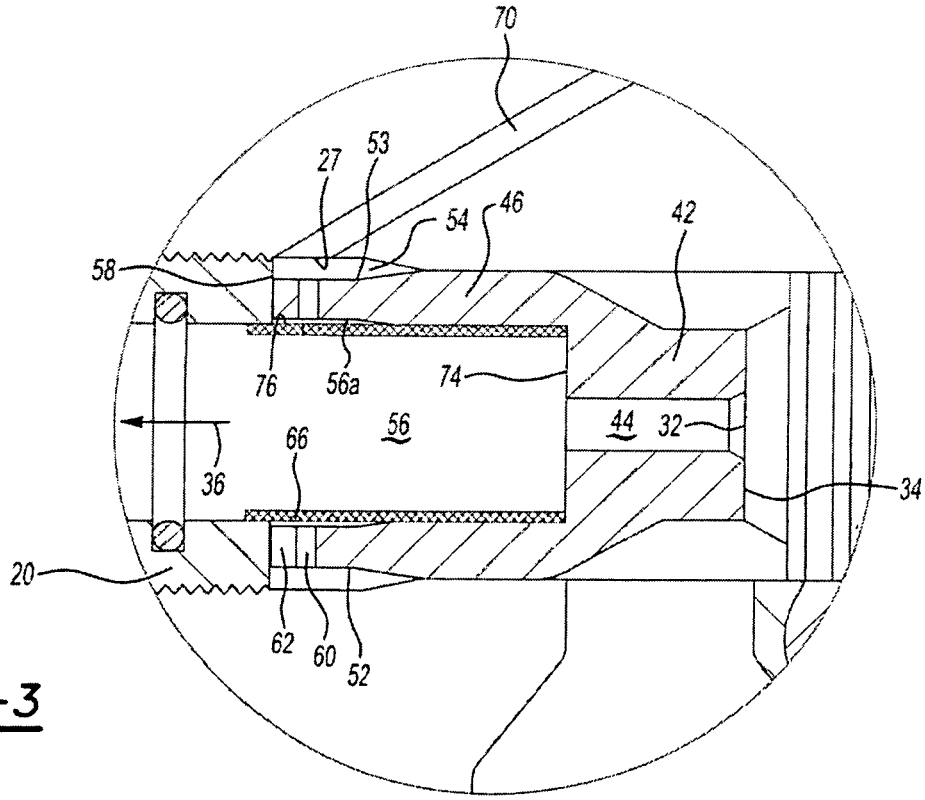
FIG. 3 is an enlarged cross-section area of the flow control member as illustrated in FIG. 1.

As illustrated in FIGS. 1-3, the flow control member 38 includes a reduced diameter flow control portion 42 having an outlet passage 44 adjacent to the orifice 34. As illustrated, the reduced diameter flow control portion 42 cooperates with the bore 26 to form the annular fluid flow chamber 40. The flow control member 38 further includes a body portion 46 circumferentially sized to fit in and sealingly engage the bore 26. The outer circumferential surface 48 of the body portion 46 includes a knurled or raised surface 50, see FIG. 2, that engages and secures the flow control member 38 within the bore 26. In the preferred embodiment, the flow control member 38 is press fit or driven into the bore 26. The flow control member 38 further includes a reduced diameter outlet end 52 opposite the reduced diameter flow control portion 42. The reduced diameter outlet end 52 includes an outer surface 53 that cooperates with an inner surface 27 of with the bore 26 to form an annular fluid pressure chamber 54 (FIG. 3).

The flow control member 38 further includes an annular cavity 56 extending to the rear end 58 of the flow control member 38 on one side and communicating with the outlet passage 44 on the opposite side. The annular cavity 56 has a diameter greater than the outlet passage 44 and correspondingly forms a ledge or seat 74 at the interface or junction of the cavity 56 and outlet passage 44. The flow control member 38 also includes at least one aperture 60 extending through the sidewall 62 of the outlet end 52. Accordingly, the aperture 60 provides for fluid flow or communication between the cavity 56 and the fluid pressure chamber 54.

A filter 64 is disposed within the annular cavity 56 and filters the fluid passing from the cavity 56 through the aperture 60 and into the fluid pressure chamber 54. In the present embodiment, the filter 64 is a cylindrically shaped screen 66 sized to fit within the annular cavity 56. Accordingly, depending upon the size of the particulate matter to be filtered, the screen size is selected accordingly. As illustrated, the screen 66 sits on the ledge or seat 74 and extends to a point slightly past the rear end 58 of the flow control member 38 and into the passageway 68 formed in the outlet fitting or adapter 20.

As illustrated, a fluid pressure passageway 70 transmits fluid from the fluid pressure chamber 54 to a pressure sensing chamber 72 located at the end of the flow control valve assembly 24 housing the spring 28. The fluid pressure passageway 70 functions as a pressure regulating mechanism and fluid relief system. For example, the flow rate through the fluid discharge port 14 and into the fluid flow chamber 40 is proportional to the speed of the engine driving the pump. When the engine is operating at low speeds, the spring 28 biases the valve body 30 to a closed position whereby the bypass port 22 is closed and the fluid output pressure downstream of the orifice 34 is communicated through the fluid pressure passage 70 to the pressure sensing chamber 72 which adds to the spring force on the valve body 30. In this manner, the entire output from the rotor or pumping element flows through the outlet passage 44 and to the outlet fitting or adapter 20. As the pump speed increases, the pressure in the fluid flow chamber 40 correspondingly increases and forces the valve body 30 against the spring 28 to a position opening the bypass port 22 and enabling fluid flow through the bypass port 22 to the suction passageway or fluid reservoir. In addition, fluid from the pressure sensing chamber 72 then travels through the fluid pressure passageway 70 into the fluid pressure chamber 54. Accordingly, as the valve body 30 moves within the bore 26, the volume of fluid in the fluid pressure sensing chamber 72 changes, this change is accommodated by fluid flow through the fluid pressure passage 70.

One advantage of the present invention is that the filter 64 is disposed such that the flow of the fluid through the cavity 56 and through the outlet fitting or adapter 20 in the direction of the arrow 36 makes the filter self-cleaning. For example, as the fluid exits through the cavity 56 contamination that builds up on the screen 66 is washed away. Further, the hydraulic or pumping action occurring as the valve body 30 moves reciprocally within the valve bore 26, will also help to dislodge any contaminants from the screen in the area of the aperture 60 whereby the fluid flow through the cavity 56 will wash the contamination away.

Further, since the reduced diameter rear end 58 creates an annular fluid pressure chamber 54, the flow control member 38 does not necessarily have to be located within the bore 26 such that the aperture 60 is adjacent to the fluid flow pressure passage 70. In operation, the fluid flows into and out of the cavity 56 from the fluid flow pressure passageway 70 through the aperture 60 and the screen 66 located in the rear end 52 of the flow control member 38. The fluid in the annular fluid pressure chamber 54 which communicates with the fluid pressure passage 70. Thus, any contaminants are trapped on the screen 66 adjacent the aperture 60. In addition, as shown in FIG. 3, an annular space 76 is created between the screen 66 and the larger diameter inner surface **56*a* of the cavity 56 to increase the surface area of the screen 66 acting as a filter. Whereby filtered fluid passing through the screen 66 at any point travels through the annular space 76 between the screen 66 and the inner surface 56*a* of the cavity 56 and exits through the aperture 60. Since only filtered fluid travels through the fluid pressure passage 70 to the fluid pressure chamber 54, the likelihood of any contaminants causing sticking or preventing proper valve body 30** operation is greatly reduced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A power steering pump comprising:

a housing having a bore with a longitudinal axis;

a fluid discharge port extending into the bore for communicating flow of pressurized fluid into said bore;

a fluid outlet located at one end of said bore for providing fluid output flow from said pump;

a fluid bypass port communicating with the bore for providing a pressure relief flow path from said pump;

a flow control valve slidably received in the bore for reactively diverting fluid flow from said fluid discharge port in response to differential pressures applied to opposite ends of said flow control valve, said bore further including a pressure sensing chamber located adjacent a first end of said flow control valve and said fluid outlet being located adjacent a second end of said flow control valve;

said housing further including a fluid pressure passageway communicating with and extending between said fluid outlet and said pressure sensing chamber to communicate fluid under pressure between said fluid outlet and said pressure sensing chamber;

said fluid outlet includes a flow control member having an outlet passageway at a first end and a cylindrical cavity extending from said outlet passageway towards a second end, wherein said flow control member is in open communication between said flow control valve and said fluid outlet;

said flow control member having a first portion of a first outer diameter approximately equal to the diameter of said bore to allow said member to be fixedly secured within said bore, and a second portion of a second outer diameter adjacent said first diameter;

said second outer diameter being lesser than said first outer diameter and said second portion having an aperture therein, said aperture providing communication between said cavity and said fluid pressure passageway;

and said cylindrical cavity having a first portion of an inner wall with a first inner diameter and a second portion of said inner wall with a second inner diameter that is greater than said first diameter; and a filter located in said cavity between said fluid outlet and said fluid pressure passageway, spaced from said second portion of said inner wall of said cylindrical cavity to define an annular space therebetween and filtering only fluid traveling from said cavity through said aperture and into said fluid pressure passageway.

2. A power steering pump as set forth in claim 1, wherein said filter includes a screen.

3. A power steering pump as set forth in claim 1, wherein said filter is a cylindrical screen sized to fit and be held in place against said first inner diameter portion of said inner wall.

4. A power steering pump as set forth in claim 1, wherein an annular fluid pressure chamber is located between said flow control member and said bore, and said fluid pressure passageway communicates with said fluid pressure chamber.

5. A power steering pump as set forth in claim 1, wherein said filter is located in said flow control member between said outlet passage and said fluid pressure passage and positioned to not filter or otherwise interrupt fluid flowing from said outlet passage in said flow control member to said fluid outlet.

6. A power steering pump as set forth in claim 1, wherein said second portion of said flow control member is spaced from said bore to define an annular fluid pressure chamber providing communication between said aperture and said fluid pressure passageway.

7. A power steering pump as in claim 3, wherein said cylindrical screen with said second portion of said inner wall form an inner annular space that provides communication between said filter and said aperture.

8. A power steering pump as in claim 5, wherein said filter is a screen mesh located in said flow control member so that fluid flow through said outlet passage to said fluid outlet can remove particles caught by said mesh due to filtering fluid flowing from said outlet passage to said fluid pressure passage.

* * * * *